US005647076A

United States Patent [19]

Gearhart

[11] Patent Number: 5,647,076

[45] Date of Patent: Jul. 15, 1997

[54] MATERNITY SUPPORT CUSHION

[76] Inventor: Susan K. Gearhart, 6805 E. Waco Dr., Syracuse, Ind. 46567

[21] Appl. No.: 646,132

[22] Filed: May 7, 1996

[51] Int. Cl.[6] ..... A47C 27/00; A47C 20/02

[52] U.S. Cl. ..... 5/631; 5/632; 5/930

[58] Field of Search ..... 5/631, 640, 630, 5/632, 722, 735, 930

[56] References Cited

U.S. PATENT DOCUMENTS

| | | | |
|---|---|---|---|
| 1,295,770 | 2/1919 | Lamont | 5/722 |
| 1,386,652 | 8/1921 | Patton | 5/640 |
| 1,548,728 | 8/1925 | Milam | 5/735 |
| 2,046,645 | 7/1936 | Mason | 5/723 |
| 4,021,872 | 5/1977 | Powell | 5/930 |
| 4,054,960 | 10/1977 | Petit et al. | 5/930 |
| 4,290,155 | 9/1981 | Hanson | 5/722 |
| 4,397,052 | 8/1983 | Lund, III | 5/631 |
| 4,665,575 | 5/1987 | Raught | 5/722 |
| 4,819,287 | 4/1989 | Halverson | 5/930 |
| 4,944,059 | 7/1990 | Wall | 5/631 |
| 5,014,375 | 5/1991 | Coonrad et al. | 5/631 |
| 5,103,516 | 4/1992 | Stevens | 5/632 |
| 5,400,449 | 3/1995 | Satto | 5/631 |

*Primary Examiner*—Alexander Grosz

*Attorney, Agent, or Firm*—Taylor & Associates, P.C.

[57] ABSTRACT

The invention is directed to a maternity support cushion for supporting a pregnant woman in a prone position. A generally U-shaped support cushion supports an upper body of the woman, and includes two extending legs and a center connecting portion. A pelvic support cushion supports the pelvic area of the woman, and is at least partially received between the two extending legs of the U-shaped support cushion. The pelvic support cushion is slidable between the two extending legs in directions toward and away from the center connecting portion.

14 Claims, 2 Drawing Sheets

MATERNITY SUPPORT CUSHION

BACKGROUND OF THE INVENTION

1. Field of the Invention

The present invention relates to a cushion for supporting a person in a prone position, and, more particularly, to a cushion for supporting a pregnant woman in a prone position.

2. Description of the Related Art

People typically like to be disposed in one or more preferred positions when lying down to rest or sleep. For example, a particular person may prefer to sleep on her back, side and/or stomach. However, during the latter stages of pregnancy, a pregnant woman typically must sleep on her back or side since the abdomen protrudes extensively from the body. A pregnant woman therefore typically does not have the option to sleep on her stomach during the latter stages of pregnancy.

One known apparatus which allows a pregnant woman to sleep on her stomach during the latter stages of pregnancy is a bed mattress which has an abdomen receiving opening therein. Such a mattress is of course large in size, and cannot be easily moved from one location to another. It is also known to provide a cushion which has a shape which essentially matches the contour of the side of the abdomen, and supports the abdomen when the pregnant woman is lying on her side. Finally, it is also known to provide a one piece cushion which has an abdomen receiving opening therein, and which supports both the upper body and the pelvic area of a pregnant woman. However, such a one piece cushion cannot be adjusted for women with different sized abdomens.

What is needed in the art is a maternity support cushion which supports both the upper body and pelvic area of a pregnant woman, and which is adjustable in size to accommodate the particular sized abdomen of the pregnant woman.

SUMMARY OF THE INVENTION

The present invention provides a maternity support cushion including a U-shaped support cushion for supporting the upper body of the pregnant woman, and a pelvic support cushion which is received at least partially within the U-shaped support cushion and supports the pelvic area of the pregnant woman.

The invention comprises, in one form thereof, a maternity support cushion for supporting a pregnant woman in a prone position. A generally U-shaped support cushion supports an upper body of the woman, and includes two extending legs and a center connecting portion. A pelvic support cushion supports the pelvic area of the woman, and is at least partially received between the two extending legs of the U-shaped support cushion.

An advantage of the present invention is that a pregnant woman may relatively comfortably rest in the prone position during pregnancy.

Another advantage is that the maternity support cushion of the present invention is adjustable to accommodate women having different sized stomachs.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
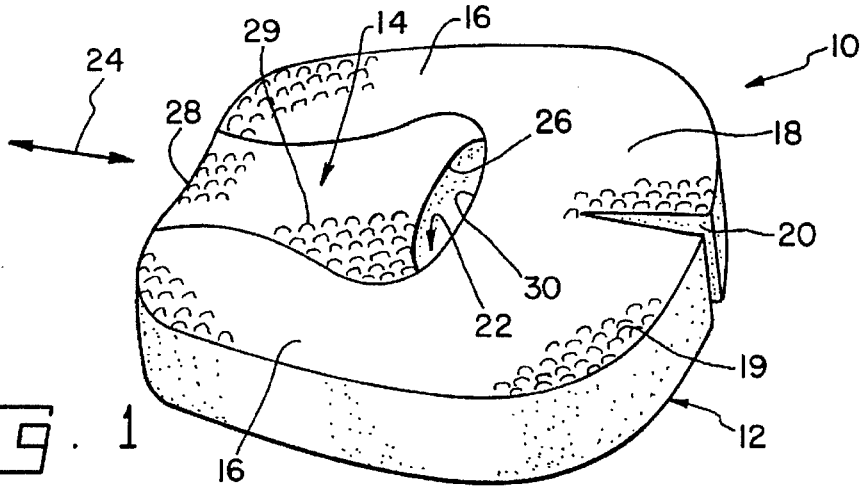
FIG. 1 is a perspective view of an embodiment of a maternity support cushion of the present invention.

Referring now to the drawings and particularly to FIG. 1, there is shown a perspective view of an embodiment of a support cushion assembly or maternity support cushion 10 of the present invention, including a generally U-shaped cushion 12 and a pelvic support cushion 14. Maternity support cushion 10 is used for supporting a pregnant woman (not shown) in a prone position.

U-shaped support cushion 12 supports the upper body of the pregnant woman. U-shaped support cushion 12 includes two extending legs 16 and a center connecting portion 18. Legs 16 and center connecting portion 18 may include a convoluted top surface 19, shown in part in FIG. 1. Center connecting portion 18 includes an opening in the form of a slot 20 which defines a breathing space for the pregnant woman. U-shaped cushion 12 also defines an abdomen receiving opening 22 disposed between legs 16. Center connecting portion 18 includes a concave surface 30 disposed adjacent to abdomen receiving opening 22.

Pelvic support cushion 14 supports the pelvic area of the pregnant woman. Pelvic support cushion 14 is at least partially received within abdomen receiving opening 22 and between legs 16 of U-shaped support cushion 12. Pelvic support cushion 14 is slidable in directions toward and away from center connecting portion 18, as indicated by double-ended arrow 24. Pelvic support cushion 14 includes a wide end 26 and a narrow end 28 which may be selectively received between legs 16 of U-shaped cushion 12. Wide end 26 and narrow end 28 are each formed with a concave surface which is alternatively and selectively adapted to be disposed adjacent to the lower portion of the abdomen of the pregnant woman. Pelvic support cushion 14 may include a convoluted top surface 29, shown in part in FIG. 1.

U-shaped cushion 12 is formed from a resilient material which allows legs 16 to be deflected in a direction toward and away from pelvic support cushion 14, as indicated by double-ended arrows 32. Thus, as pelvic support cushion 14 is moved between legs 16 in directions toward and away from center connecting portion 18, as indicated by double-ended arrow 24, legs 16 may move in the direction transverse to the movement of pelvic support cushion 14, as indicated by double-ended arrows 32.

Figure 2:
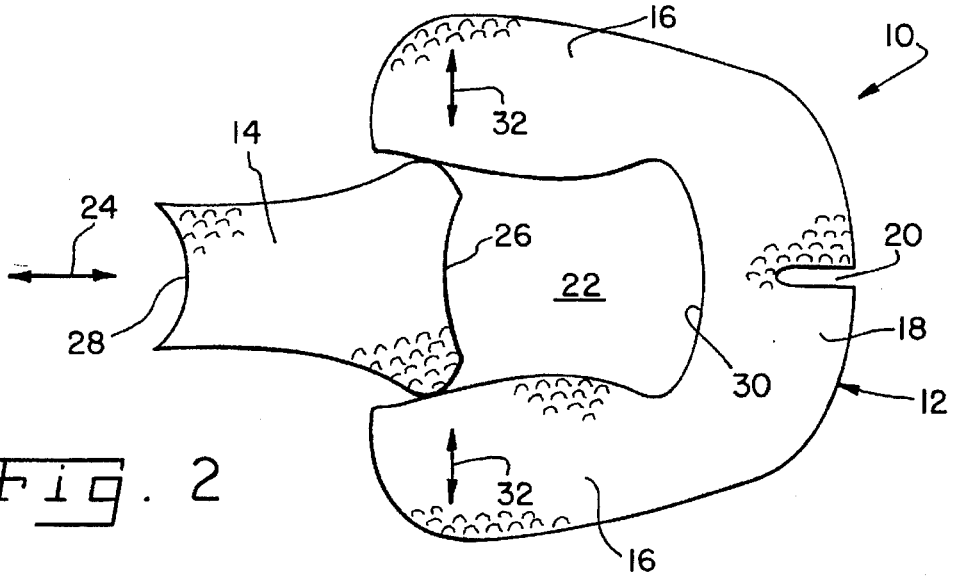
FIG. 2 is a top view of the support cushion shown in FIG. 1, with a wide end of the pelvic support cushion shown in engagement with the U-shaped cushion.

Referring now to FIG. 2, pelvic support cushion 14 is shown with wide end 26 being disposed between and in engagement with legs 16. With wide end 26 disposed between legs 16 as shown, a pregnant woman having a relatively larger abdomen may comfortably utilize maternity support cushion 10. Pelvic support cushion 14 is preferably positioned relative to U-shaped cushion 12 such that concave surface 30 and wide end 26 are respectively disposed adjacent to the upper and lower portions of the abdomen of the pregnant woman. Alternatively, support cushion 14 may be positioned relative to U-shaped cushion 12 such that the enlarged breasts of the pregnant woman may also be placed within abdomen receiving opening 22 and adjacent to concave surface 30.

Figure 3:
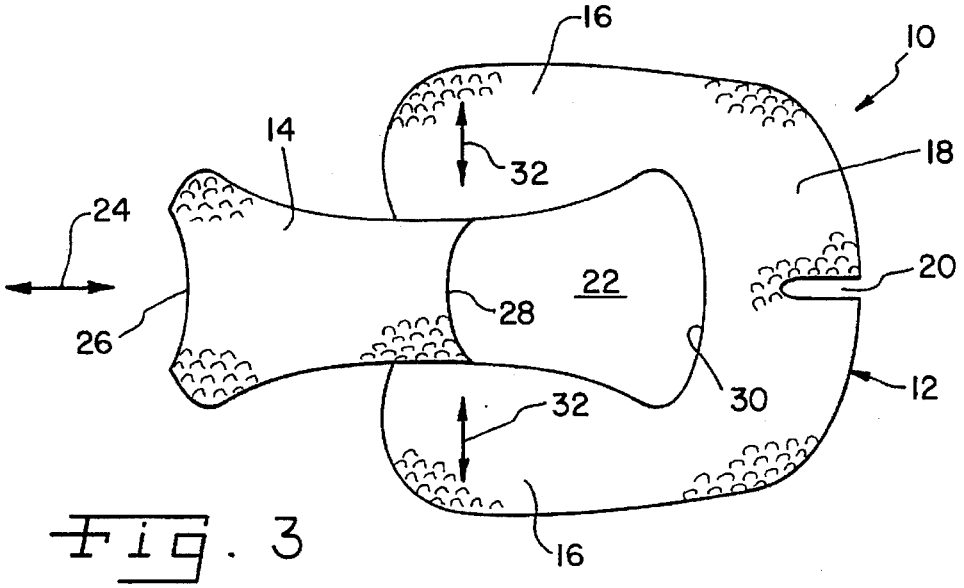
FIG. 3 is a top view of the support cushion shown in FIG. 1, with a narrow end of the pelvic support cushion shown in engagement with the U-shaped cushion.

Referring now to FIG. 3, pelvic support cushion 14 is shown with narrow end 28 being disposed between and in engagement with legs 16. With pelvic support cushion positioned as such, a pregnant woman having a relatively smaller sized abdomen may comfortably utilize maternity support cushion 10. Of course, narrow end 28 may be moved toward and away from center connecting portion 18, as indicated by double-ended arrow 24.

Figure 4:
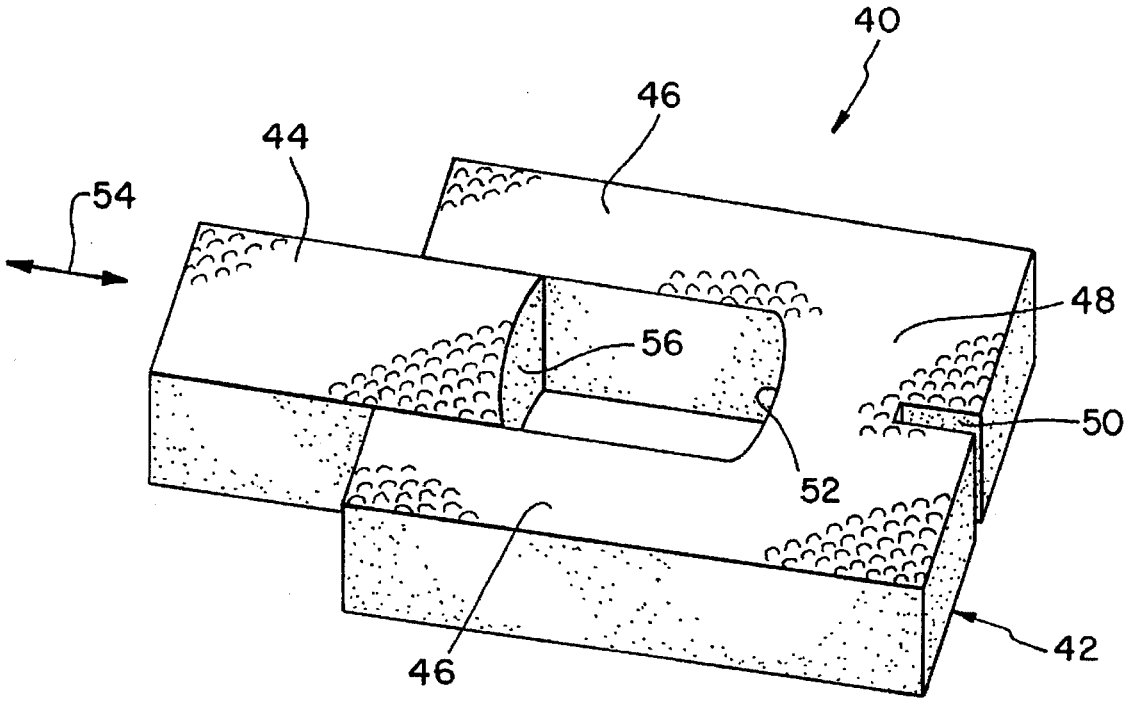
FIG. 4 is a perspective view of another embodiment of a maternity support cushion of the present invention.

Referring now to FIG. 4, there is shown a perspective view of another embodiment of a maternity support cushion 40 of the present invention, including a U-shaped support cushion 42 and a pelvic support cushion 44.

U-shaped support cushion 42 includes extending legs 46, a center connecting portion 48, slot 50, and concave surface 52, similar to U-shaped support cushion 12 described above.

Pelvic support cushion 44 supports the pelvic area of the pregnant woman, and is at least partially received between legs 46 of U-shaped support cushion 42. Pelvic support cushion 44 is slidable between legs 46 in directions toward and away from center connecting portion 48, as indicated by double-ended arrow 54. Pelvic support cushion 44 is substantially rectangular shaped, and includes one end 56 thereof defining a concave surface. Pelvic support cushion 44 is movable relative to U-shaped support cushion 42 so as to accommodate pregnant women having different sized abdomens.

In the embodiments shown in FIGS. 1–4 above, U-shaped support cushions 12, 42 and pelvic support cushions 14, 44 are preferably formed from a foam rubber material having a resiliency which is sufficient to uphold the weight of the woman while at the same time being comfortable to the woman. However, U-shaped support cushions 12, 42 and pelvic support cushions 14, 44 may also be constructed in the form of a fluid (e.g., water) filled cushion, air filled cushion, or plastic bead filled cushion. Further, U-shaped support cushions 12, 42 and pelvic support cushions 14, 44 are formed with a thickness which is sufficient to allow use by nearly any sized pregnant woman without the abdomen "bottoming out" within the abdomen receiving opening formed between legs 16, 46 (i.e., the thickness is essentially a "worse case" thickness). However, it will be appreciated that maternity support cushions 10, 40 may be formed with one of a plurality of thicknesses depending upon the size of the pregnant woman.

Further, in the embodiments shown in FIGS. 1–4, support cushions 14, 44 are utilized as pelvic support cushions for supporting the pelvic area of a user. However, it should be understood that U-shaped support cushions 12, 42 and support cushions 14, 44 may be reversed during use such that center connecting portions 18, 48 support the pelvic area of a user, and support cushions 14, 44 support the head and/or chest of a user. Support cushions 14, 44 therefore each define a slidable support cushion which is slidable relative to the U-shaped support cushion and at least partially received between the two extending legs of the U-shaped support cushion. Configured as such, the relative movement between U-shaped support cushion 12, 42 and support cushions 14, 44 still provides adjustment therebetween to allow for abdomens of different sizes.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A maternity support cushion for supporting a pregnant woman in a prone position, comprising:

a generally U-shaped support cushion for supporting an upper body of the woman, said U-shaped support cushion including two extending legs and a center connecting portion, said extending legs, including distal ends; and a pelvic support cushion for supporting the pelvic area of the woman, said pelvic support cushion including a wide end and a narrow end, each of said wide end and said narrow end being configured to be received between said two extending legs of said U-shaped support cushion; and wherein said extending legs of said U-shaped support cushion are deflectable in directions toward and away from each other, said extending legs disposed in a first position when said narrow end of said pelvic support cushion is received therebetween and said extending legs disposed in a second, deflected position when said wide end of said pelvic support cushion is received therebetween, said wide end being selectively positionable between said extending legs at a plurality of locations ranging between said center connecting portion and said distal ends.

2. The maternity support cushion of claim 1, wherein said pelvic support cushion is slidable between said two extending legs in directions toward and away from said center connecting portion.

3. The maternity support cushion of claim 1, wherein said pelvic support cushion includes at least one end with a concave surface.

4. The maternity support cushion of claim 3, wherein each of said wide end and said narrow end include said concave surface.

5. The maternity support cushion of claim 1, wherein one end of said pelvic support cushion includes a concave surface.

6. The maternity support cushion of claim 1, wherein said center connecting portion of said U-shaped cushion includes an opening therein defining a breathing space for the pregnant woman.

7. The maternity support cushion of claim 6, wherein said opening comprises a slot.

8. A support cushion assembly for supporting a person in a prone position, comprising:

a generally U-shaped support cushion including two extending legs and a center connecting portion; and a slidable support cushion being slidable relative to said two extending legs of said U-shaped support cushion, said slidable support cushion including a wide end and a narrow end, each of said wide end and said narrow end being configured to be received between said two extending legs of said U-shaped support cushion;

wherein one of said U-shaped support cushion and said slidable support cushion is configured for supporting an upper body of the person, and an other of said U-shaped support cushion and said slidable support cushion is configured for supporting a pelvic area of the person; and wherein said extending legs of said U-shaped support cushion are deflectable in directions toward and away from each other, said extending legs disposed in a first position when said narrow end of said pelvic support cushion is received therebetween and said extending legs disposed in a second, deflected position when said wide end of said pelvic support cushion is received therebetween, said wide end being selectively positionable between said extending legs at a plurality of locations ranging between said center connecting portion and said distal ends.

9. The support cushion assembly of claim 8, wherein said U-shaped support cushion is configured for supporting the upper body of the person, and said slidable support cushion is configured for supporting the pelvic area of the person.

10. The support cushion assembly of claim 8, wherein said U-shaped support cushion is configured for supporting the pelvic area of the person, and said slidable support cushion is configured for supporting the upper body of the person.

11. The support cushion assembly of claim 8, wherein said slidable support cushion is slidable between said two extending legs in directions toward and away from said center connecting portion.

12. The support cushion assembly of claim 8, wherein said slidable support cushion includes at least one end with a concave surface.

13. The support cushion assembly of claim 12, wherein each of said wide end and said narrow end include said concave surface.

14. A maternity support cushion for supporting a pregnant woman in a prone position, comprising:

a generally U-shaped support cushion for supporting an upper body of the woman, said U-shaped support cushion including two extending legs and a center connecting portion, said center connecting portion including an opening therein defining a breathing space for the pregnant woman; and a pelvic support cushion for supporting the pelvic area of the woman, said pelvic support cushion including a wide end and a narrow end, each of said wide end and said narrow end being selectively received between said two extending legs of said U-shaped support cushion, each of said wide end and said narrow end including a concave surface, said pelvic support cushion being slidable between said two extending legs in directions toward and away from said center connecting portion.

* * * * *